US008094146B2

(12) United States Patent
Yamamoto et al.

(10) Patent No.: US 8,094,146 B2
(45) Date of Patent: Jan. 10, 2012

(54) DRIVING METHOD FOR PIXEL CIRCUIT AND DISPLAY APPARATUS

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 120 days.

(21) Appl. No.: 12/659,801

(22) Filed: Mar. 22, 2010

(65) Prior Publication Data

US 2010/0289793 A1 Nov. 18, 2010

(30) Foreign Application Priority Data

May 12, 2009 (JP) ..... 2009-115196

(51) Int. Cl.
*G09G 5/00* (2006.01)

(52) U.S. Cl. ..... 345/212; 345/76; 345/213

(58) Field of Classification Search ..... 345/76–83, 345/87–100, 204–215
See application file for complete search history.

(56) References Cited

U.S. PATENT DOCUMENTS

| | | | | |
|---|---|---|---|---|
| 6,356,026 | B1 * | 3/2002 | Murto | 315/111.81 |
| 6,693,388 | B2 * | 2/2004 | Oomura | 315/169.3 |
| 2004/0046164 | A1 | 3/2004 | Kobayashi et al. | |
| 2005/0206590 | A1 | 9/2005 | Sasaki et al. | |

FOREIGN PATENT DOCUMENTS

| | | |
|---|---|---|
| JP | 2003-255856 | 9/2003 |
| JP | 2003-271095 A | 9/2003 |

* cited by examiner

*Primary Examiner* — Vijay Shankar
(74) *Attorney, Agent, or Firm* — Rader, Fishman & Grauer PLLC

(57) ABSTRACT

Disclosed here is a driving method for a pixel circuit which includes a light emitting element, a driving transistor for applying current in response to a signal value applied between a gate and a source thereof to the light emitting element when a driving voltage is applied between a drain and the source thereof, and a holding capacitor connected between the gate and the source of the driving transistor for holding the input signal value, the driving method comprising steps carried out within a light emitting period of one cycle which includes a no-light emitting period and the light emitting period, the steps including a first step to a sixth step.

6 Claims, 15 Drawing Sheets

-t0 t0-t1 t1-t2 t2-t3 t3, t4-t5-t6 t6-t7 t7-t8 t8-t9 t9-

$$I_{ds}=\frac{1}{2}\mu\frac{W}{L}C_{ox}(V_{gs}-V_{th})^2$$

DRIVING METHOD FOR PIXEL CIRCUIT AND DISPLAY APPARATUS

BACKGROUND OF THE INVENTION

1. Field of the Invention

This invention relates to a driving method for a pixel circuit and a display apparatus having a pixel array including a plurality of pixel circuits disposed in a matrix.

Japanese Patent Laid-Open Nos. 2003-255856 and 2003-271095 are known as related art documents to the inventor.

2. Description of the Related Art

In a display apparatus of the active matrix type wherein an organic electroluminescence (EL) light emitting element is used in a pixel, current to flow through a light emitting element in each pixel circuit is controlled by an active element, usually a thin film transistor (TFT), provided in the pixel circuit. In particular, since an organic EL element is a current light emitting element, a gradation of emitted light is obtained by controlling the amount of current to flow through the EL element.

An example of a related art pixel circuit which uses an organic EL element is shown in FIG. 12A.

It is to be noted that, although only one pixel circuit is shown in FIG. 12A, in an actual display apparatus, m×n such pixel circuits as shown in FIG. 12A are disposed in a matrix, that is, an m×n matrix, such that each pixel circuit is selected and driven by a horizontal selector 101 and a write scanner 102.

Referring to FIG. 12A, the pixel circuit shown includes a sampling transistor Ts in the form of an n-channel TFT, a holding capacitor Cs, a driving transistor Td in the form of a p-channel TFT, and an organic EL element 1. The pixel circuit is disposed at a crossing point between a signal line DTL and a write controlling line WSL. The signal line DTL is connected to a terminal of the sampling transistor Ts and the write controlling line WSL is connected to the gate of the sampling transistor Ts.

The driving transistor Td and the organic EL element 1 are connected in series between a power supply potential Vcc and the ground potential. Further, the sampling transistor Ts and the holding capacitor Cs are connected to the gate of the driving transistor Td. The gate-source voltage of the driving transistor Td is represented by Vgs.

In the pixel circuit, if the write controlling line WSL is placed into a selected state and a signal value corresponding to a luminance signal is applied to the signal line DTL, then the sampling transistor Ts is rendered conducting and the signal value is written into the holding capacitor Cs. The signal potential written in the holding capacitor Cs becomes a gate potential of the driving transistor Td.

If the write controlling line WSL is placed into a non-selected state, then the signal line DTL and the driving transistor Td are electrically disconnected from each other. However, the gate potential of the driving transistor Td is kept stably by the holding capacitor Cs. Then, driving current Ids flows through the driving transistor Td and the organic EL element 1 from the power supply potential Vcc toward the ground potential.

At this time, the current Ids exhibits a value corresponding to the gate-source voltage Vgs of the driving transistor Td, and the organic EL element 1 emits light with a luminance in accordance with the current value.

In particular, in the present pixel circuit, a signal value potential from the signal line DTL is written into the holding capacitor Cs to vary the gate application voltage of the driving transistor Td thereby to control the value of current to flow to the organic EL element 1 to obtain a gradation of color development.

Since the driving transistor Td in the form of a p-channel TFT is connected at the source thereof to the power supply potential Vcc and is designed in such a manner as to normally operate in a saturation region, the driving transistor Td serves as a constant current source having a value given by the following expression (1):

$$Ids=(1/2)\cdot\mu\cdot(W/L)\cdot Cox\cdot(Vgs-Vth)^2 \quad (1)$$

where Ids is current flowing between the drain and the source of a transistor which operates in a saturation region, μ the mobility, W the channel width, L the channel length, Cox the gate capacitance, and Vth the threshold voltage of the driving transistor Td.

As apparently recognized from the expression (1) above, in the saturation region, the drain current Ids of the transistor is controlled by the gate-source voltage Vgs. Since the gate-source voltage Vgs is kept fixed, the driving transistor Td operates as a constant current source and can drive the organic EL element 1 to emit light with a fixed luminance.

FIG. 12B illustrates a time-dependent variation of the current-voltage (I-V) characteristic of an organic EL element. A curve shown by a solid line indicates a characteristic in an initial state, and another curve shown by a broken line indicates the characteristic after time-dependent variation. Generally, the I-V characteristic of an organic EL element deteriorates as time passes as seen from FIG. 12B. In the pixel circuit of FIG. 12A, the drain voltage of the driving transistor Td varies together with time-dependent variation of the organic EL element 1. However, since the gate-source voltage Vgs in the pixel circuit of FIG. 12A is fixed, a fixed amount of current flows to the organic EL element 1 and the emitted light luminance does not vary. In short, stabilized gradation control can be carried out.

On the other hand, if the driving transistor Td is formed from an n-channel TFT, then it becomes possible to use a related art amorphous silicon (a-Si) process in TFT fabrication. This makes it possible to reduce the cost of a TFT substrate.

FIG. 13A shows a configuration wherein the driving transistor Td in the form of a p-channel TFT of the pixel circuit shown in FIG. 12A is replaced with an n-channel TFT.

Referring to FIG. 13A, in the pixel circuit shown, the driving transistor Td is connected at the drain side thereof to the power supply potential Vcc and at the source thereof to the anode of the organic EL element 1 thereby to form a source follower circuit.

However, where the driving transistor Td is replaced with an n-channel TFT in this manner, since it is connected at the source thereof to the organic EL element 1, the gate-source voltage Vgs varies together with such time-dependent variation of the organic EL element 1 as illustrated in FIG. 12B. Consequently, the amount of current flowing to the organic EL element 1 varies, and as a result, the emitted light luminance of the organic EL element 1 varies. In other words, appropriate gradation control cannot be carried out any more.

Further, in an organic EL display apparatus of the active matrix type, in addition to time-dependent variation of the organic EL element 1, also the threshold voltage of an n-channel TFT of a component of the pixel circuit varies as time passes. As apparent from the expression (1) given hereinabove, if the threshold voltage Vth of the driving transistor Td varies, then the drain current Ids of the driving transistor Td varies. Consequently, the amount of current flowing to the EL element varies, and as a result, the emitted light luminance of the EL element varies. Further, since the threshold value and the mobility of the driving transistor Td differ among different pixels, a dispersion occurs in the value of current in accordance with the expression (1) and also the emitted light luminance differs among different pixels.

As a circuit which prevents an influence of time-dependent variation of an organic EL element and a characteristic dispersion of a driving transistor upon the emitted light luminance and besides includes a comparatively small number of elements, a circuit shown in FIG. 13B has been proposed.

Referring to FIG. 13B, a holding capacitor Cs is connected between the gate and the source of a driving transistor Td. Further, a drive scanner 103 applies a driving voltage Vcc and an initial voltage Vss alternately to a power supply controlling line DSL. In other words, the driving voltage Vcc and the initial voltage Vss are applied at predetermined timings to the driving transistor Td.

FIG. 14 illustrates operation waveforms of the pixel circuit of FIG. 13B. It is to be noted that, while FIG. 14 illustrates a gate potential variation and a source potential variation of the driving transistor Td, solid line curves indicate the variations in the case of high gradation display such as a white display and broken line curves indicate the variations in the case of low gradation display such as, for example, display of a color near to the black.

First, at time t100 at which a light emission period of a preceding frame ends, the drive scanner 103 applies the initial voltage Vss to the power supply controlling line DSL to initialize the source potential of the driving transistor Td.

Then, within a period of time t101 within which the reference value potential Vofs is applied to the signal line DTL by the horizontal selector 101, a write scanner 102 renders the sampling transistor Ts conducting to fix the gate potential of the driving transistor Td to the reference value Vofs. In this state, within a period from time t102 to time t103, the drive scanner 103 applies the driving voltage Vcc to the driving transistor Td to cause the holding capacitor Cs to hold the threshold voltage Vth of the driving transistor Td. In short, a threshold value correction operation is carried out.

Thereafter, within a period (from time t104 to time t105) within which the signal value potential is applied from the horizontal selector 101 to the signal line DTL, the sampling transistor Ts is rendered conducting under the control of the write scanner to write the signal value into the holding capacitor Cs. At this time, also mobility correction of the driving transistor Td is carried out.

Thereafter, current in accordance with the signal value written in the holding capacitor Cs flows to the organic EL element 1 to carry out emission of light with a luminance in accordance with the signal value.

By the operation described, an influence of a dispersion in threshold value or mobility of the driving transistor Td is canceled. Further, since the gate-source voltage of the driving transistor Td is kept at a fixed value, the current flowing to the organic EL element 1 does not vary. Therefore, even if the I-V characteristic of the organic EL element 1 deteriorates, the current Ids normally continues to flow and the emitted light luminance does not vary.

SUMMARY OF THE INVENTION

Here, the voltage of the driving transistor Td and the organic EL element 1 in the high gradation display and the low gradation display are studied.

FIG. 14 illustrates the voltages of the gate and the source of the driving transistor Td upon high gradation display and low gradation display. As seen in FIG. 14, within a period other than a threshold value correction period and a threshold value correction preparation period, the gate-source voltage Vgs is high (VghH) upon high gradation display but is low (VghL) upon low gradation display.

Generally, a TFT exhibits a variation of the threshold voltage Vth in response to the gate-source voltage Vgs thereof.

In the operation waveforms of FIG. 14, the gate-source voltage Vgs indicates the voltage VgsH within a no-light emitting period upon high gradation display. On the other hand, upon low gradation display, the gate-source voltage Vgs indicates the voltage VgsL within a no-light emitting period. If the gate-source voltage Vgs is varied by the gradation within a no-light emitting period, then a pixel which is used frequently for high gradation display indicated by the solid line curve exhibits a greater variation of the threshold voltage Vth of the driving transistor Td by a time-dependent variation than another pixel which is used frequently for low gradation display indicated by the broken line curve.

Further, the variation of the gate potential with respect to the variation of the source potential is studied here. Since, in the pixel circuit shown in FIG. 13B, since the capacitor Cs is formed between the gate and the source of the driving transistor Td, even if the source potential varies as described above, the gate-source voltage Vgs is kept fixed.

However, such parasitic capacitances Cgd and Cgs and parasitic capacitance Cws as seen in FIG. 15A exist in the driving transistor Td and the sampling transistor Ts, respectively. Therefore, the variation value ΔVg of the gate potential strictly exhibits such a variation value as given by the following expression (2) with respect to the variation ΔVs of the source potential:

$$\begin{aligned}\Delta Vg &= \{(Cs + Cgs)/(Cs + Cgs + Cgd + Cws)\} \times \Delta Vs \\ &= g \cdot \Delta Vs\end{aligned} \tag{2}$$

where g represents (Cs+Cgs)/(Cs+Cgs+Cgd+Cws) and is a value called boot strap gain.

Then, the variation value ΔVgs of the gate-source voltage Vgs is given by $$\begin{aligned}\Delta Vgs &= g \cdot \Delta Vs - \Delta Vs \\ &= -(1 - g)\Delta Vs\end{aligned} \tag{3}$$

In other words, the gate-source voltage Vgs varies by (1−g)× ΔVs as a result of the variation of the source voltage Vs.

Therefore, the signal voltage-current characteristic of the panel exhibits a shift to the high potential side as seen in FIG. 15B with respect to the variation of the threshold voltage Vth of the driving transistor Td and the light emission voltage variation of the organic EL element 1. It is to be noted that the panel current in FIG. 15B may be considered as current flowing to the organic EL element 1.

As seen in FIG. 15B, although current I0 initially flows with respect to a signal value Vsig0, with a pixel which frequently displays a low gradation, current I1 flows with respect to the signal value Vsig0 by the shift by ΔVL as a result of the time-dependent variation. On the other hand, with another pixel which is frequently used to display a high gradation, a shift by ΔVH occurs as a result of time-dependent variation over the same period, and current I2 flows with respect to the signal value Vsig0. For example, in the case of a television broadcast, those pixels at a portion at which time is displayed display white of a high gradation for a considerably long period of time, and with such pixels, the threshold variation of the driving transistor Td appears conspicuously.

Then, those pixels which frequently display low gradations and those pixels which frequently display high gradations exhibit different current values with respect to the same signal value after lapse of a fixed period of time as seen in FIG. 15B.

As described hereinabove, in the operation illustrated in FIG. 14, within a period other than the threshold value correction period and the threshold value correction preparation period, the difference in gate-source voltage Vgs between the high gradation display and the low gradation display appears conspicuously. Therefore, the operation is very disadvantageous in regard to a screen burn.

Within the light emitting period, the gate-source voltage Vgs indicates a value corresponding to the signal value and a gradation is represented by the gate-source voltage Vgs. Therefore, it is unavoidable that the gate-source voltage Vgs becomes different for each pixel. However, also within the no-light emitting period, a large difference in gate-source voltage Vgs is kept as it is for a comparatively long period of time, and this promotes the difference in variation degree of the threshold voltage for each pixel.

Therefore, it is demanded to provide a driving method for a pixel circuit and a display apparatus wherein the difference in variation degree of the threshold value of a driving transistor Td for each pixel is reduced and reduction of a screen burn by a difference in current degradation is implemented.

According to an embodiment of the present invention, there is provided a driving method for a pixel circuit which includes a light emitting element, a driving transistor for applying current in response to a signal value applied between a gate and a source thereof to the light emitting element when a driving voltage is applied between a drain and the source thereof, and a holding capacitor connected between the gate and the source of the driving transistor for holding the input signal value. The driving method includes steps carried out within a light emitting period of one cycle which includes a no-light emitting period and the light emitting period. The steps includes: a first step of ending a light emitting operation of the light emitting element; a second step of fixing the gate of the driving transistor to a predetermined potential and applying a driving voltage between the drain and the source of the driving transistor to initialize the gate-source voltage of the driving transistor; a third step of canceling the fixation of the gate potential of the driving transistor and ending the application of the driving voltage between the drain and the source of the driving transistor to maintain the initialization state of the gate-source voltage; a fourth step of fixing the gate of the driving transistor to a reference voltage and applying the driving voltage between the drain and the source of the driving transistor to carry out threshold value correction so that the gate-source voltage of the driving transistor may become equal to a threshold voltage of the driving transistor; a fifth step of applying a voltage as a signal value to the holding capacitor and executing a mobility correction operation of the driving transistor; and a sixth step of supplying current corresponding to the gate-source voltage of the driving transistor on which the signal value is reflected to the light emitting element so that emission of light of the light emitting element with a luminance corresponding to the signal value is executed.

According to another embodiment of the present invention, there is provided a display apparatus including a pixel array including a plurality of pixel circuits disposed in a matrix and each including a light emitting element, a driving transistor for supplying current in response to a signal value applied between a gate and a source thereof to the light emitting element when a driving voltage is applied between a drain and the source thereof, and a holding capacitor connected between the gate and the source of the driving transistor for holding the input signal value, and a light emission driving section configured to apply the signal value to the holding capacitor of each of the pixel circuits of the pixel array so that the light emitting element of the pixel circuit emits light with a luminance corresponding to the signal value. The light emission driving section drives the pixel circuit to carry out, as light emitting operation of one cycle which includes a no-light emitting period and a light emitting period, ending a light emitting operation of the light emitting element, fixing the gate of the driving transistor to a predetermined potential and applying a driving voltage between the drain and the source of the driving transistor to initialize the gate-source voltage of the driving transistor, canceling the fixation of the gate potential of the driving transistor and ending the application of the driving voltage between the drain and the source of the driving transistor to maintain the initialization state of the gate-source voltage, fixing the gate of the driving transistor to a reference voltage and applying the driving voltage between the drain and the source of the driving transistor to carry out threshold value correction so that the gate-source voltage of the driving transistor may become equal to a threshold voltage of the driving transistor, applying a voltage as a signal value to the holding capacitor and executing a mobility correction operation of the driving transistor, and supplying current corresponding to the gate-source voltage of the driving transistor on which the signal value is reflected to the light emitting element so that emission of light of the light emitting element with a luminance corresponding to the signal value is executed.

In the driving method for the pixel circuit and the display apparatus, since the gate-source voltage of the driving transistor of the pixel circuit is initialized within the no-light emitting period, the gate-source voltage for each pixel is fixed within the light emitting period irrespective of the display gradation. In short, within the no-light emitting period, no difference appears in the gate-source voltage for each pixel.

With the driving method for the pixel circuit and the display apparatus, the gate-source voltage of the driving transistor can be fixed till operation regarding threshold value correction within the no-light emitting period irrespective of high luminance display/low luminance display, and the difference in threshold value variation by high gradation display/low gradation display for each pixel can be reduced. In short, the difference in time-dependent variation of the current flowing to the light emitting element can be reduced. Consequently, reduction of a screen burn by a difference in current degradation can be implemented.

DETAILED DESCRIPTION OF THE PREFERRED EMBODIMENTS

In the following, preferred embodiments of the present invention are described in detail in the following order with reference to the accompanying drawings.

1. Configuration of the Display Apparatus and the Pixel Circuit
2. Pixel Circuit Operation Taken into Consideration in the Course to an Embodiment of the Present Invention
3. Pixel Circuit Operation in the Embodiment
4. Pixel Circuit Operation According to Another Embodiment 1. Configuration of the Display Apparatus and the Pixel Circuit FIG. 1 shows a configuration of an organic EL display apparatus to which an embodiment of the present invention is applied.

Figure 1:
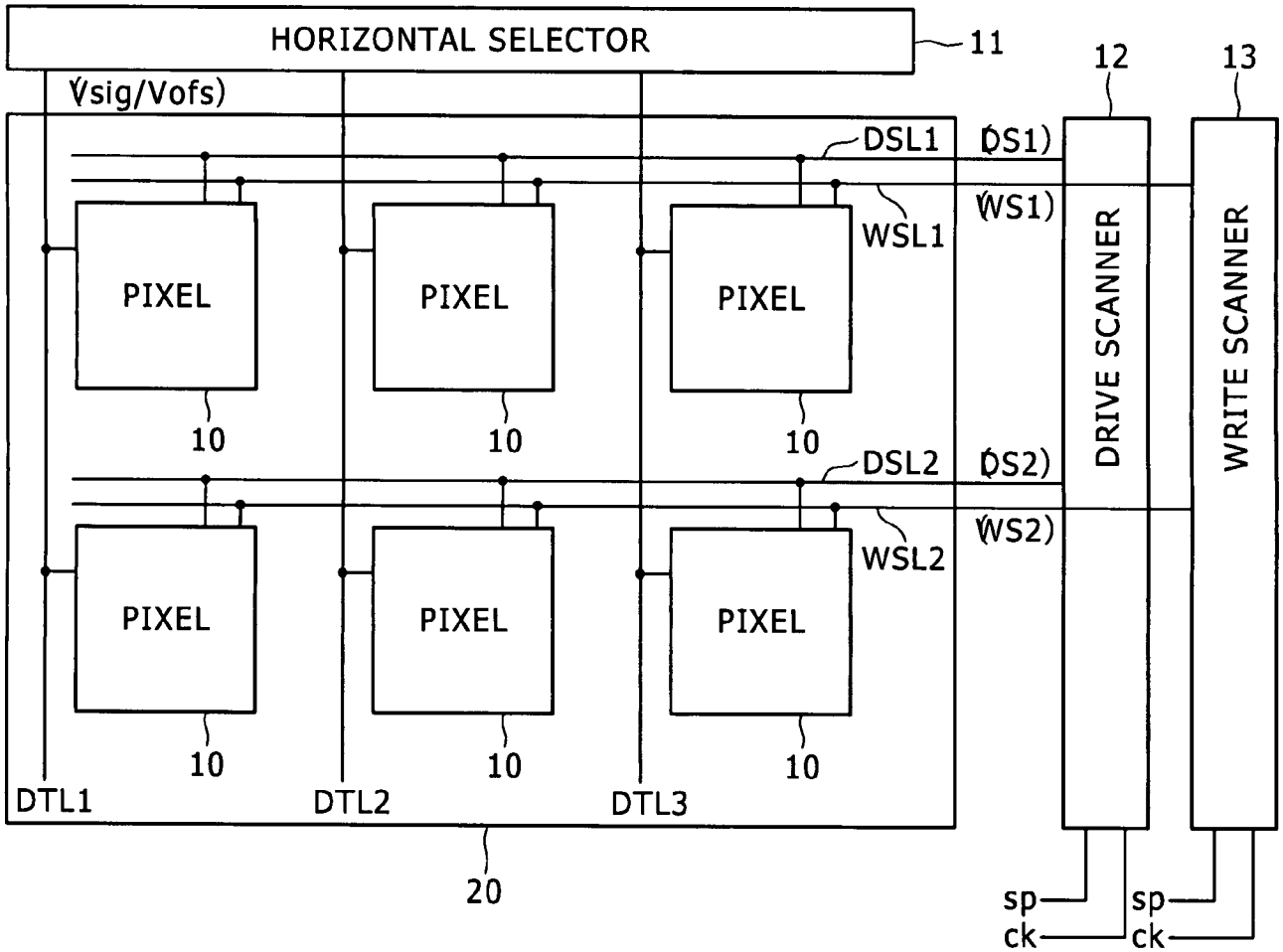
FIG. 1 is a block diagram showing a configuration of a display apparatus to which an embodiment of the present invention is applied.

Referring to FIG. 1, the organic EL display apparatus shown includes a plurality of pixel circuits 10 which use an organic EL element as a light emitting element thereof and are driven to emit light in accordance with an active matrix method.

In particular, the organic EL display apparatus includes a pixel array 20 including a large number of pixel circuits 10 arrayed in a matrix, that is, in m rows and n columns. It is to be noted that each of the pixel circuits 10 serves as a light emitting pixel for red (R) light, green (G) light or blue (B) light and the pixel circuits 10 of the colors are arrayed in a predetermined rule to form the color display apparatus.

The organic EL display apparatus includes, as components for driving the pixel circuits 10 to emit light, a horizontal selector 11, a drive scanner 12 and a write scanner 13.

Signal lines DTL1, DTL2, . . . for being selected by the horizontal selector 11 to supply a voltage corresponding to a signal value or gradation value of a luminance signal as display data are disposed so as to extend in the direction of a column on the pixel array 20. The number of such signal lines DTL1, DTL2, . . . is equal to the number of columns of the pixel circuits 10 disposed in a matrix on the pixel array 20.

Further, write controlling lines WSL1, WSL2, . . . and power supply controlling lines DSL1, DSL2, . . . are disposed so as to extend in the direction of a row on the pixel array 20. The number of such write controlling lines WSL and power supply controlling lines DSL is equal to the number of rows of the pixel circuits 10 disposed in a matrix on the pixel array 20.

The write controlling lines WSL, that is, WSL1, WSL2, . . . , are driven by the write scanner 13. The write scanner 13 successively supplies scanning pulses WS, that is, WS1, WS2, . . . , to the write controlling lines WSL1, WSL2, . . . disposed in the direction of a row at predetermined timings to line-sequentially scan the pixel circuits 10 in a unit of a row.

The power supply controlling lines DSL, that is, DSL1, DSL2, . . . are driven by the drive scanner 12. The drive scanner 12 supplies power supply pulses DS, that is, DS1, DS2, . . . , to the power supply controlling lines DSL1, DSL2, . . . in a timed relationship with the line-sequential scanning by the write scanner 13. The power supply pulses DS, that is, DS1, DS2, . . . , exhibit a power supply voltage which changes over between two values of a driving voltage Vcc and an initial voltage Vss.

It is to be noted that the drive scanner 12 and the write scanner 13 set the timing of the scanning pulses WS and the power supply pulses DS based on a clock ck and a start pulse sp.

The horizontal selector 11 supplies a signal value potential Vsig as an input signal to the pixel circuits 10 and a reference value potential Vofs to the signal lines DTL1, DTL2, . . . disposed in the direction of a column in a timed relationship with the line-sequential scanning by the write scanner 13.

Figure 2:
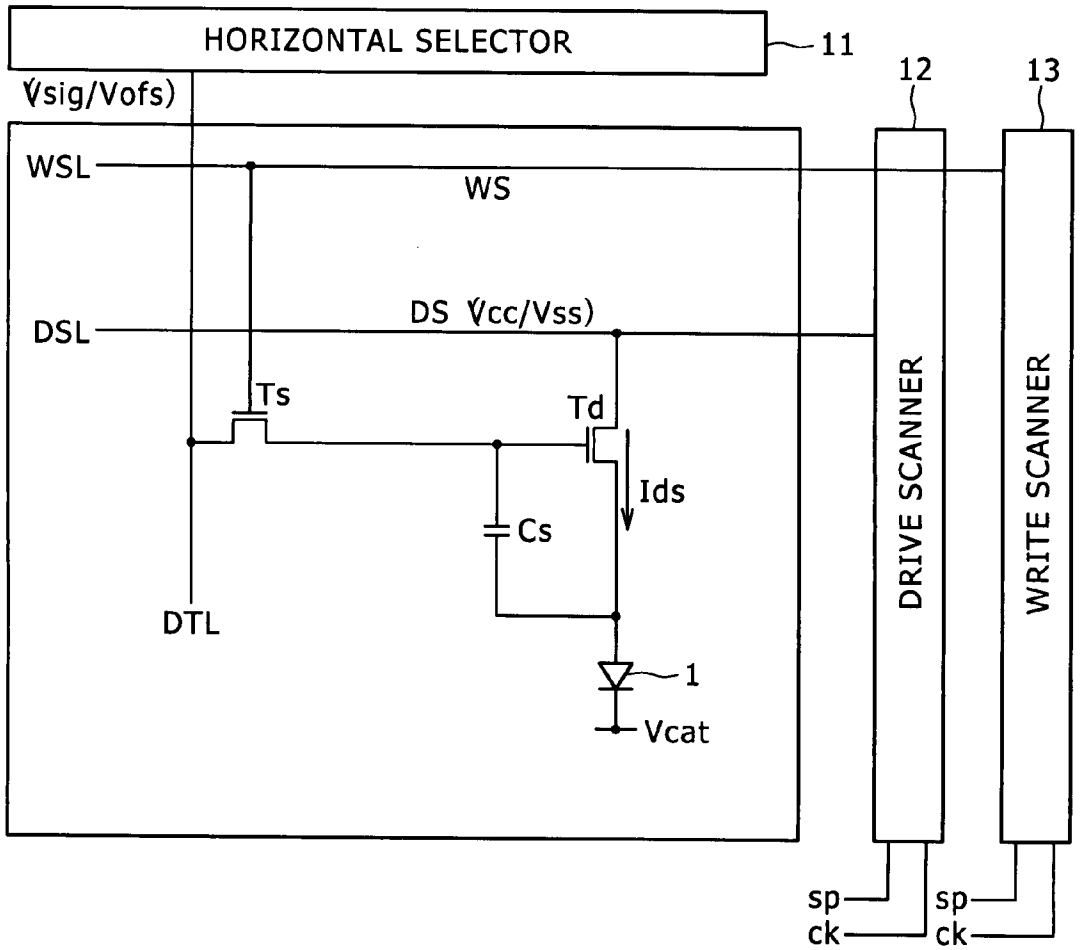
FIG. 2 is a block circuit diagram showing a pixel circuit of the display apparatus of FIG. 1.

FIG. 2 shows an example of a configuration of a pixel circuit 10. Such pixel circuits 10 are disposed in a matrix like the pixel circuits 10 in the configuration of FIG. 1. It is to be noted that, in FIG. 2, only one pixel circuit 10 disposed at a location at which a signal line DTL crosses with a write controlling line WSL and a power supply controlling line DSL is shown for simplified illustration.

Referring to FIG. 2, the pixel circuit 10 shown includes an organic EL element 1 serving as a light emitting element, a single holding capacitor Cs, and thin film transistors (TFTs) as a sampling transistor Ts and a driving transistor Td.

The holding capacitor Cs is connected at one of terminals thereof to the source of the driving transistor Td and at the other terminal thereof to the gate of the driving transistor Td.

The light emitting element of the pixel circuit 10 is an organic EL element 1 of, for example, a diode structure and has an anode and a cathode. The organic EL element 1 is connected at the anode thereof to the source of the driving transistor Td and at the cathode thereof to a predetermined wiring line, that is, to a cathode potential Vcat.

The sampling transistor Ts is connected at one of the drain and the source thereof to the signal line DTL and at the other one of the drain and the source thereof to the gate of the driving transistor Td.

Further, the sampling transistor Ts is connected at the gate thereof to the write controlling line WSL.

The driving transistor Td is connected at the drain thereof to the power supply controlling line DSL.

Light emission driving of the organic EL element 1 is carried out basically in the following manner.

At a timing at which a signal value potential Vsig is applied to the signal line DTL, a sampling transistor Ts is rendered conducting by a scanning pulse WS provided thereto from the write scanner 13 through the write controlling line WSL. Consequently, the signal value potential Vsig from the signal line DTL is written into the holding capacitor Cs.

The driving transistor Td receives supply of current from the power supply controlling line DSL to which the driving potential Vcc is applied from the drive scanner 12 and supplies current Ids in accordance with the signal potential held in the holding capacitor Cs to the organic EL element 1 to cause the organic EL element 1 to emit light.

In short, while operation that the signal value potential Vsig, that is, a gradation value, is written into the holding capacitor Cs within each frame period, the gate-source voltage Vgs of the driving transistor Td is determined in response to a gradation to be displayed.

Since the driving transistor Td operates in its saturation region, it functions as a constant current source to the organic EL element 1 and supplies current Ids in accordance with the gate-source voltage Vgs to the organic EL element 1. Consequently, the organic EL element 1 emits light of the luminance corresponding to the gradation value.

2. Pixel Circuit Operation Taken into Consideration in the Course to an Embodiment of the Present Invention The present invention is directed to implementation of reduction of a screen burn by a difference in current degradation by reducing the difference in variation degree of the threshold voltage of the driving transistor for each pixel as described hereinabove.

The reason why a difference in variation degree of the threshold voltage as a time-dependent variation appears is that, since a difference appears between the gate-source voltage of the driving transistor Td upon high gradation display and that upon low gradation display, the variation advances conspicuously with those pixels which frequently display high gradations.

However, since, within the light emitting period, the gate-source voltage Vgs has a value corresponding to the signal value and a gradation is represented by the gate-source voltage Vgs, it cannot be avoided from a principle in operation that the gate-source voltage Vgs differs for each pixel. However, since, also within the no-light emitting period, a great difference in gate-source voltage Vgs is maintained as it is, this promotes the difference in degree of variation of the threshold voltage for each pixel.

Therefore, in order to reduce the difference in degree of variation of the threshold voltage for each pixel, it is effective to eliminate the difference in gate-source voltage of the driving transistor Td irrespective of whether a high gradation is displayed or a low gradation is displayed.

Figure 14:
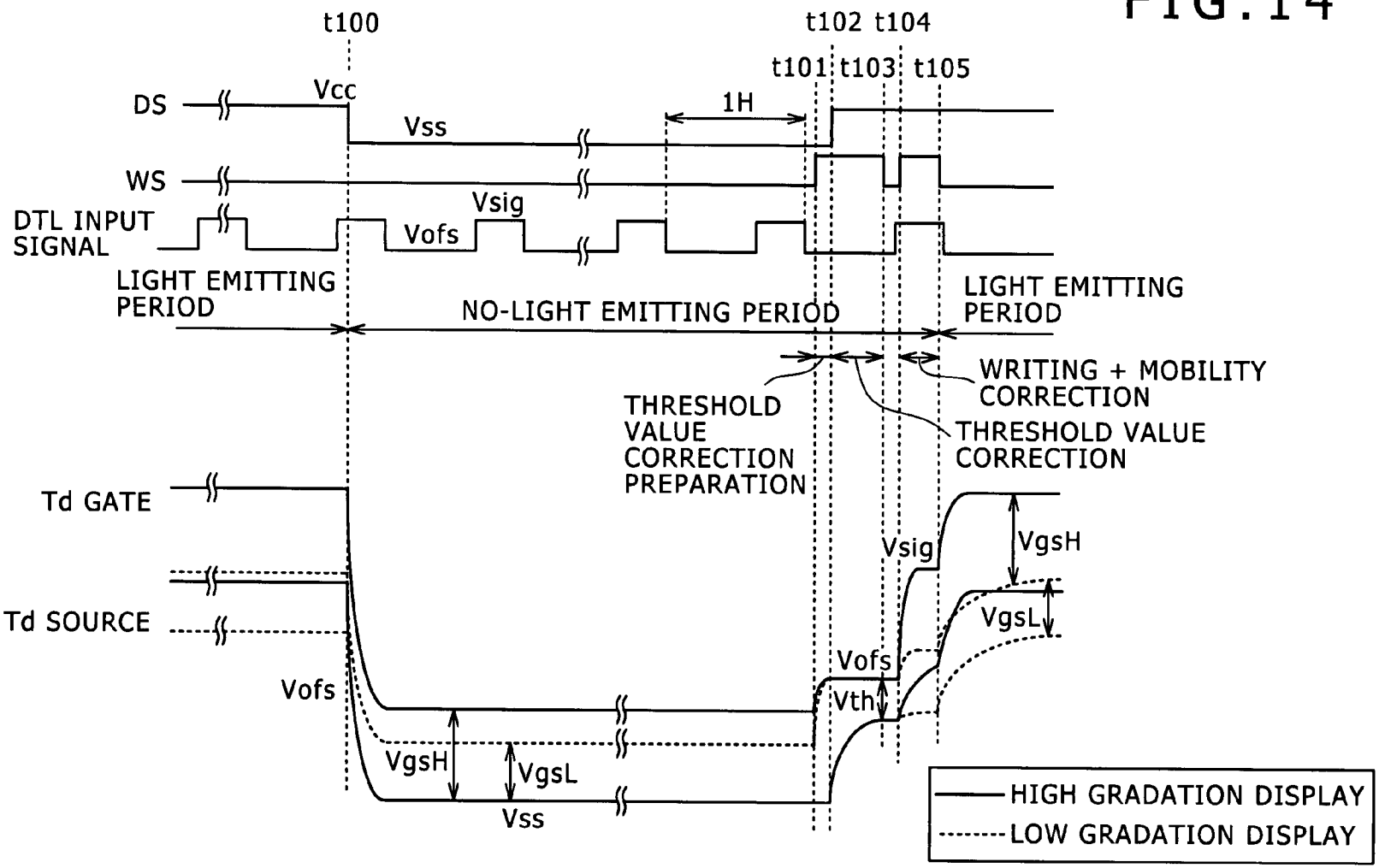
FIG. 14 is a waveform diagram illustrating operation of a related art pixel circuit.
Figure 15A:
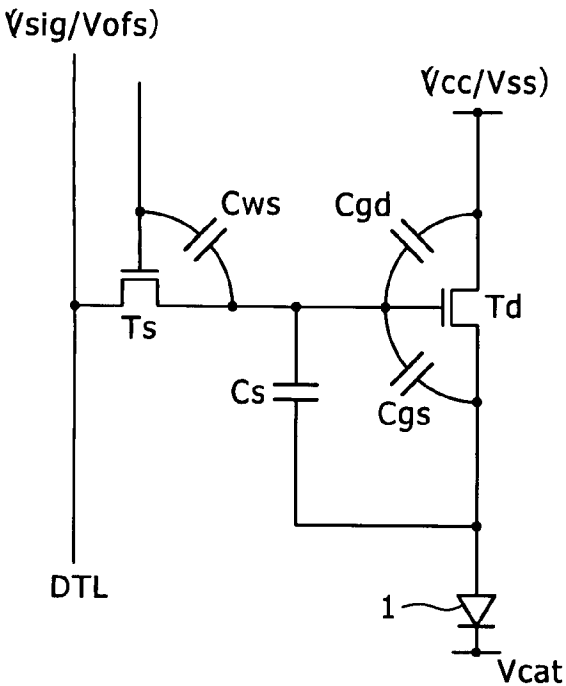
FIGS. 15A and 15B are a circuit diagram and a graph, respectively, illustrating a gate potential variation with respect to a source potential variation and time-dependent degradation.
Figure 15B:
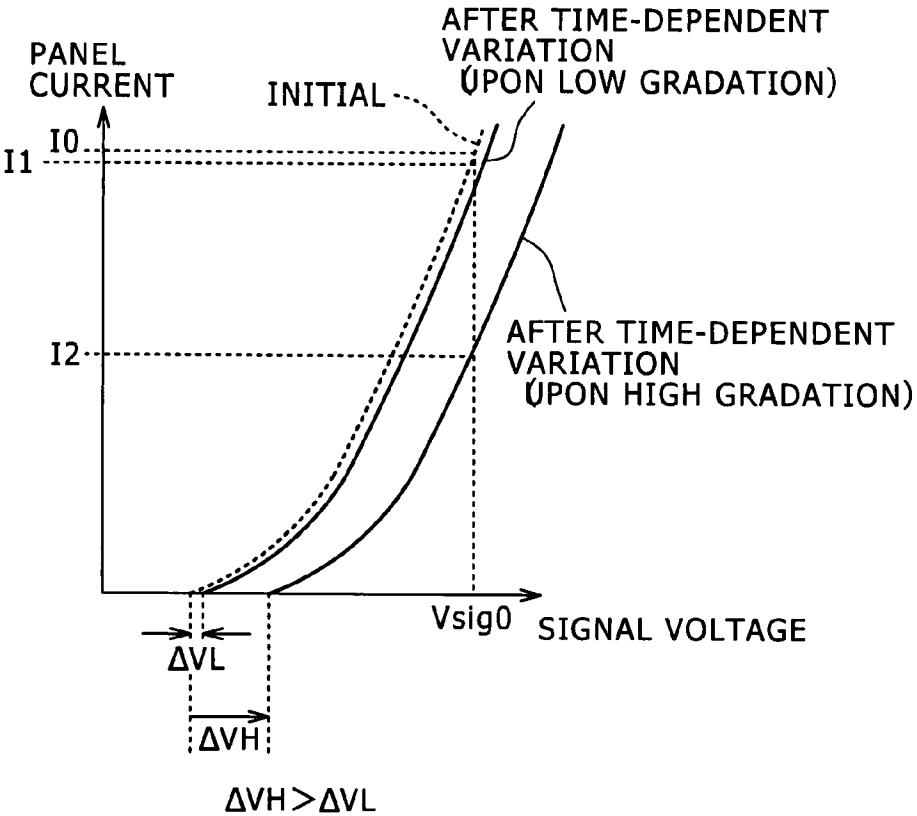

In related art, within a period from time t100 to time t101 in FIG. 14, that is, within a period before a threshold value correction preparation is started, the gate-source voltage Vgs upon high gradation display is equal to the voltage VgsH while the gate-source voltage Vgs upon low gradation display is equal to the voltage VgsL. Where the period within which a difference in gate-source voltage becomes long in this manner, the difference in threshold value becomes conspicuous between those pixels which display high gradations for a long period of time and those pixels which display low gradations for a long period of time.

Therefore, if conversely the gate-source voltage can be fixed irrespective of whether a high gradation is displayed or a low gradation is displayed within a period before a threshold value correction preparation is started, then the difference in variation degree of the threshold value can be reduced.

Therefore, various operation methods for fixing the gate-source voltage Vgs irrespective of the display gradation within a period before an operation regarding threshold value correction, that is, a threshold value correction preparation, within a no-light emitting period have been contrived.

In the following, pixel circuit operations taken into consideration for such an object as just described are described with reference to FIGS. 3, 4 and 5.

It is to be noted that, in FIGS. 3, 4 and 5 and FIGS. 6 and 11 which illustrate pixel circuit operation of embodiments of the present invention, the scanning pulse WS applied to the gate of the sampling transistor Ts by the write scanner 13 through a write controlling line WSL is illustrated.

Also a power supply pulse DS supplied from the drive scanner 12 through a power supply controlling line DSL is illustrated. As the power supply pulse DS, the driving voltage Vcc or the initial voltage Vss is applied.

Further, as a DTL input signal, a potential applied to a signal line DTL by the horizontal selector 11 is illustrated. This potential is given by the signal value Vsig or the reference value Vofs.

Further, a variation of the gate potential and a variation of the source potential of the driving transistor Td are illustrated as a Td gate and a Td source, respectively.

Further, in regard to illustration of the variations of the gate potential and the source potential, a solid line curve indicates a variation in high gradation display while a broken line curve indicates a variation in low gradation display.

Figure 3:
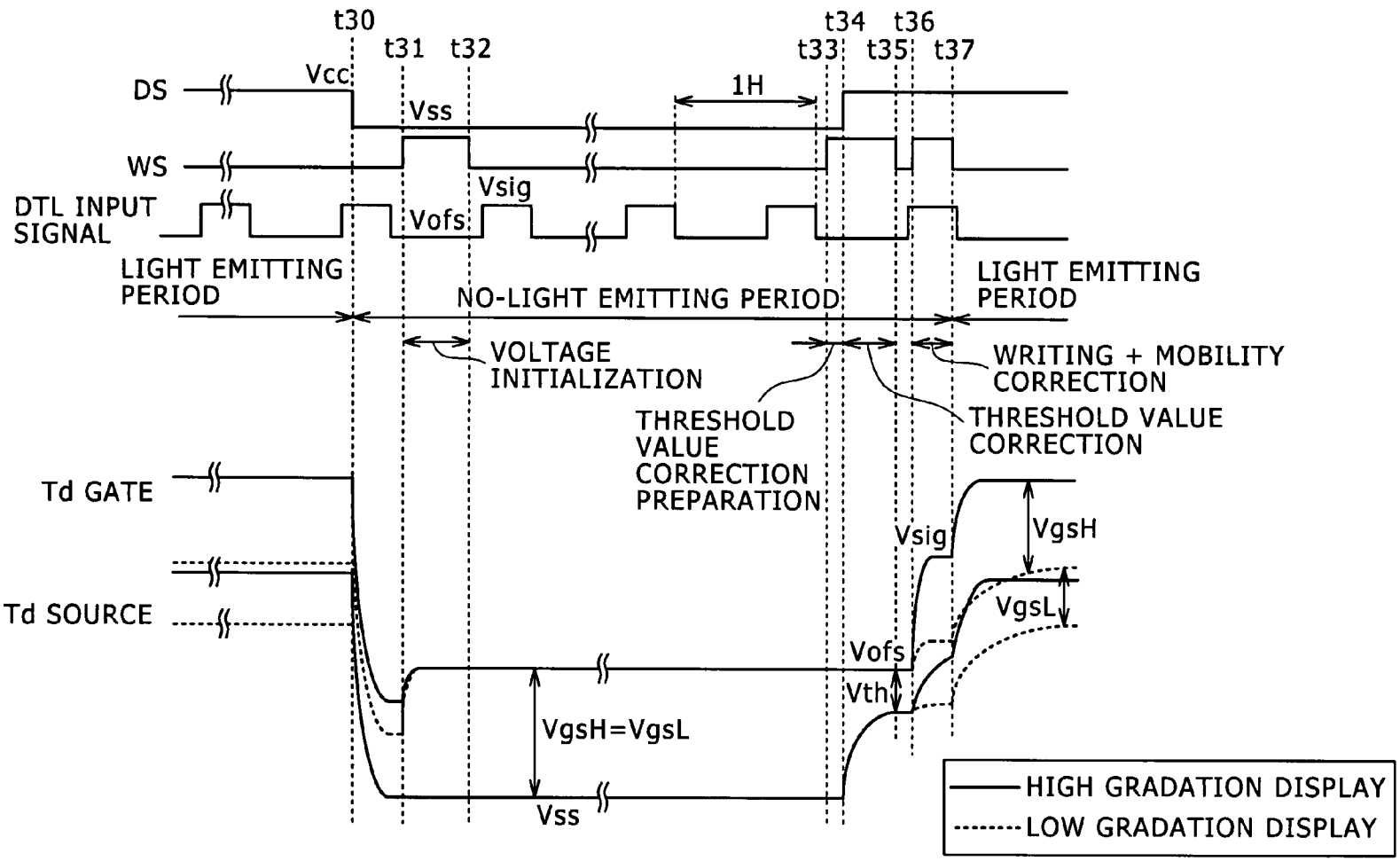
FIGS. 3, 4 and 5 are waveform diagrams illustrating pixel circuit operation in the course to an embodiment of the present invention.

The pixel circuit operation of FIG. 3 is described.

Till time t30, emission of light of a preceding frame is carried out, and a light emitting operation for one cycle of a current frame is carried out after time t30.

At time t30, the power supply pulse DS is set to the initial voltage Vss. Consequently, the gate potential and the source potential of the driving transistor Td drop. The source potential drops to the initial voltage Vss and the gate potential drops in response to the gate-source voltage Vgs in the immediately preceding state.

Since the power supply pulse DS is set to the initial voltage Vss and the supply of the driving voltage Vcc is stopped in this manner, the organic EL element 1 is turned off to stop the emission of light and thus enters a no-light emitting period.

Then within a period from time t31 to time t32, the scanning pulse WS is set to the H level to render the sampling transistor Ts conducting. Within this period, the reference value Vofs is applied to the signal line DTL by the horizontal selector 11.

In short, in this instance, the gate voltage of the driving transistor Td is initialized to the reference value Vofs. Then, since the source voltage is fixed to the initial voltage Vss, the gate-source voltage Vgs becomes equal to Vofs−Vss.

Accordingly, irrespective of high luminance display/low luminance display, the gate-source voltage Vgs is fixed. In other words, the voltage VgsH upon high gradation display is equal to the voltage VgsL upon low gradation display.

Thereafter, this state is maintained. Then, at time t33 at which the reference value Vofs is applied to the signal line DTL, the scanning pulse WS is changed over to the H level to render the sampling transistor Ts conducting thereby to carry out a threshold correction preparation.

At time t34, the power supply pulse DS is set to the driving voltage Vcc to start threshold value correction. At this time, the source potential rises until the gate-source voltage Vgs becomes equal to the threshold voltage Vth. At time t35, the scanning pulse WS is set to the L level, thereby ending the threshold value correction.

Then at time t36, while the signal value Vsig is applied to the signal line DTL, the scanning pulse WS is set to the H level to render the sampling transistor Ts conducting to carry out writing of the signal value Vsig and mobility correction. The signal value Vsig is written into the capacitor Cs.

Thereafter, at time t37, the scanning pulse WS is set to the L level to turn off the sampling transistor Ts, and thereafter, emission of light of the organic EL element 1 is carried out. In particular, current corresponding to the gate-source voltage of the driving transistor Td flows through the organic EL element 1 so that the organic EL element 1 emits light of a gradation corresponding to the signal value Vsig.

As described above, the pixel circuit operation illustrated in FIG. 3 is carried out such that, after a no-light emitting period is started, the sampling transistor Ts is turned on when the potential of the signal line DTL is the reference value Vofs to initialize the gate-source voltage of the driving transistor Td irrespective of a gradation.

Consequently, the period within which a difference in gate-source voltage Vgs occurs by low gradation display/high gradation display can be shortened.

However, as can be recognized from comparison with FIG. 14, where low gradation display is carried out, the gate-source voltage Vgs within a no-light emitting period increases from that in a related art pixel circuit operation. Therefore, there is a drawback that current degradation with a pixel which carries out low gradation display progresses unnecessarily rapidly.

Figure 4:
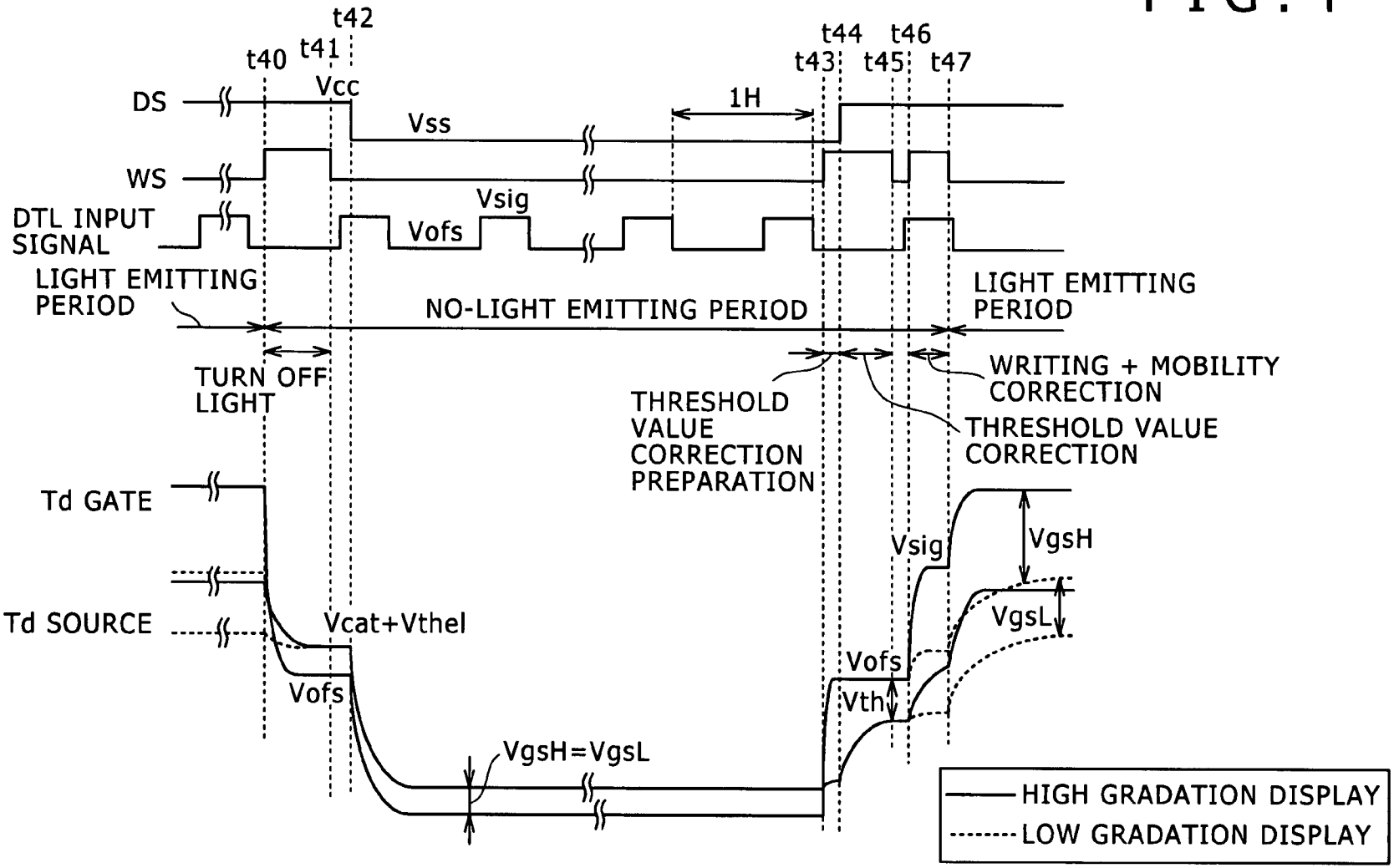

FIG. 4 illustrates an example of a method wherein the scanning pulse WS is used to stop emission of light.

Referring to FIG. 4, till time t40, emission of light in a preceding frame is carried out, and within a period from time t40 to t41, the scanning pulse WS is set to the H level to stop the emission of light. In particular, while the signal line DTL is set to the reference value Vofs, the sampling transistor Ts is turned on to set the gate voltage of the driving transistor Td to the reference value Vofs. In other words, the gate-source voltage Vgs of the driving transistor Td is set lower than the threshold voltage Vth to stop the current from flowing to the organic EL element 1 thereby to stop the emission of light. The source potential becomes equal to the threshold voltage Vthel of the organic EL element 1+cathode voltage Vcat.

Thereafter, at time t42, the power supply pulse DS is set to the initial voltage Vss. Consequently, the gate voltage and the source voltage vary in such a manner as seen in FIG. 4.

Also in this instance, irrespective of high luminance display/low luminance display, the gate-source voltage Vgs is fixed. In other words, the voltage VgsH upon high gradation display is equal to the voltage VgsL upon low gradation display.

It is to be noted that operation within a period from time t43 to t47 is similar to that within the period from time t33 to time t37.

Also by the operation described, the period within which a difference in gate-source voltage Vgs by low luminance display/high luminance display occurs can be shortened.

However, in the operation of FIG. 4, since the gate-source voltage Vgs of the driving transistor Td is set lower than the threshold voltage of the same to carry out stopping of emission of light thereof, when the power supply pulse DS of the power supply controlling line DSL is equal to the initial voltage Vss, the reverse bias voltage applied to the organic EL element 1 becomes low.

Generally, if the reverse bias voltage decreases, then the degradation in efficiency of the organic EL element 1 increases. Therefore, even if the period within which a difference in gate-source voltage Vgs by low gradation display/high gradation display is shortened to reduce the difference in degradation of the current after lapse of a fixed period of time, the degradation of the luminance increases.

In contract, also it is possible to set the voltage to be applied with the power supply pulse DS of the power supply controlling line DSL to a value lower than the initial voltage Vss to increase the reverse bias voltage to be applied to the organic EL element 1. However, this requires an increased amplitude of the power supply voltage and is disadvantageous in terms of the voltage withstanding property of an element for outputting the power supply voltage.

Figure 5:
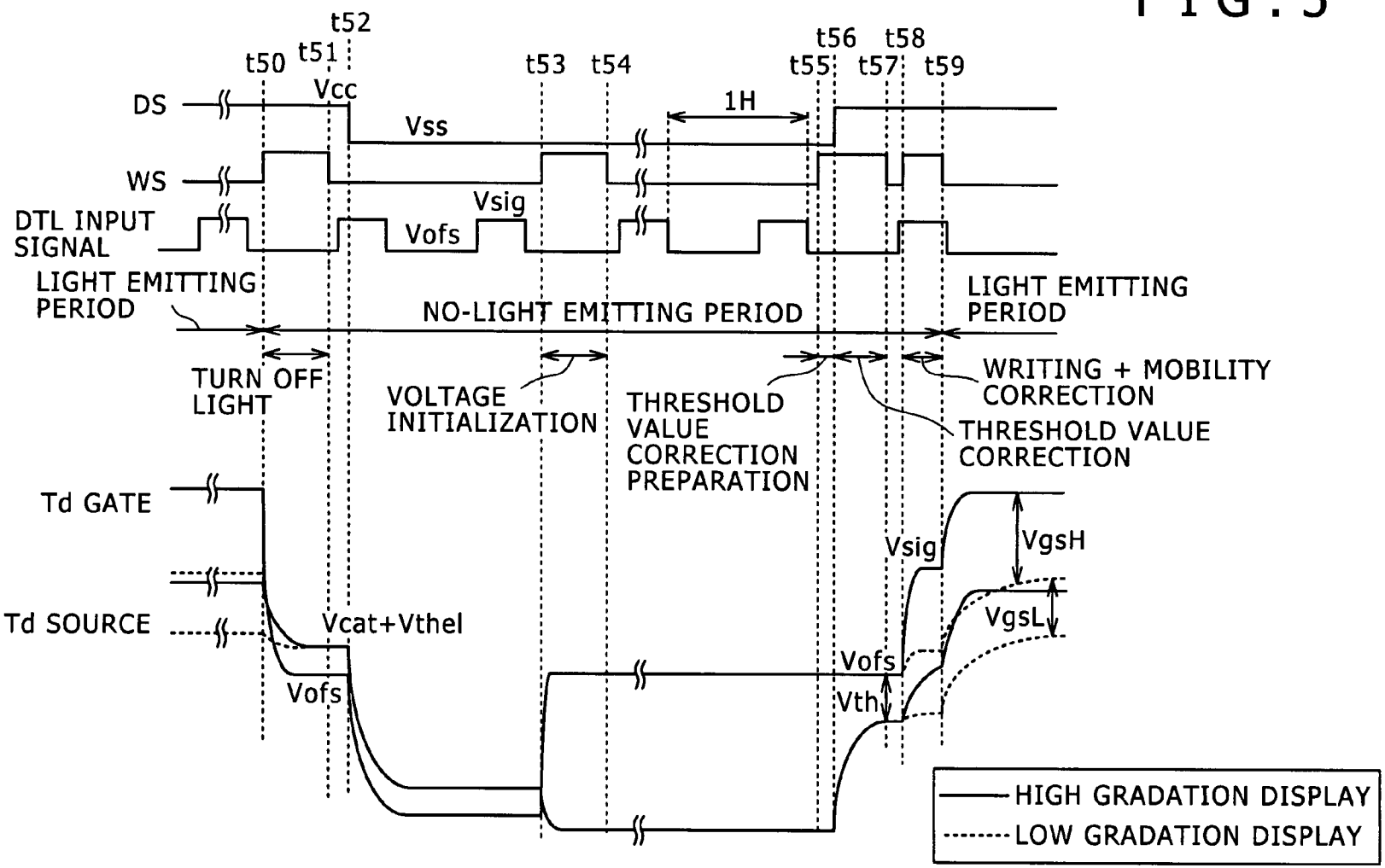

The pixel circuit operation of FIG. 5 is a combination of the operation methods described above with reference to FIGS. 3 and 4.

Referring to FIG. 5, emission of light in a preceding frame is carried out till time t50, and within a period from time t50 to time t51, the scanning pulse WS is set to the H level to stop the emission of light. In particular, similarly as in the case of FIG. 4, the gate voltage of the driving transistor Td is set to the reference value Vofs so that the gate-source voltage Vgs of the driving transistor Td becomes lower than the threshold voltage Vth of the driving transistor Td to stop current from flowing to the organic EL element 1. The source potential becomes equal to the threshold voltage Vthel of the organic EL element 1+cathode voltage Vcat.

Thereafter, at time t52, the power supply pulse DS is set to the initial voltage Vss. Consequently, the gate voltage and the source voltage vary in such a manner as seen in FIG. 5.

Further, within a period from time t53 to time t54 within which the reference value Vofs is applied from the horizontal selector 11 to the signal line DTL, the scanning pulse WS is set to the H level to carry out voltage initialization.

In this instance, the gate voltage of the driving transistor Td is initialized to the reference value Vofs. Meanwhile, the power supply pulse DS is equal to the initial voltage Vss, and the source potential is fixed to the initial voltage Vss. The gate-source voltage Vgs is equal to Vofs−Vss. Accordingly, irrespective of high gradation display/low gradation display, the gate-source voltage Vgs is fixed.

It is to be noted that operation within a period from time t55 to time t59 is similar to that within the period from time t33 to time t37 in the operation of FIG. 3.

In this instance, similarly as in the operation of FIG. 3, where low gradation display is carried out, the gate-source voltage Vgs within a no-light emitting period becomes higher than that in the related art circuit operation within a period from time t53 to time t56. Therefore, current degradation with pixels which carry out low gradation display tend to progress more rapidly than that in the related art circuit operation.

Further, within a period from time t52 to time t53, the reverse bias voltage applied to the organic EL element 1 decreases similarly as in the operation of FIG. 4.

As described above, in the operation examples of FIGS. 3, 4 and 5, the gate-source voltage Vgs is fixed irrespective of the display gradation within a period before operation regarding threshold value correction, that is, threshold value correction preparation, is carried out within a no-light emitting period. Therefore, it is possible to reduce the difference in degree of variation of the threshold voltage of the driving transistor Td for each pixel thereby to implement reduction of a screen burn by a difference in current gradation. In this regard, the operation examples are considered useful circuit operation. However, the operation examples individually have some drawbacks as described above in the description of them.

Therefore, in the embodiment of the present invention, more useful pixel circuit operation is implemented taking the drawbacks of the circuit operations described above into consideration.

3. Pixel Circuit Operation in the Embodiment

Figure 6:
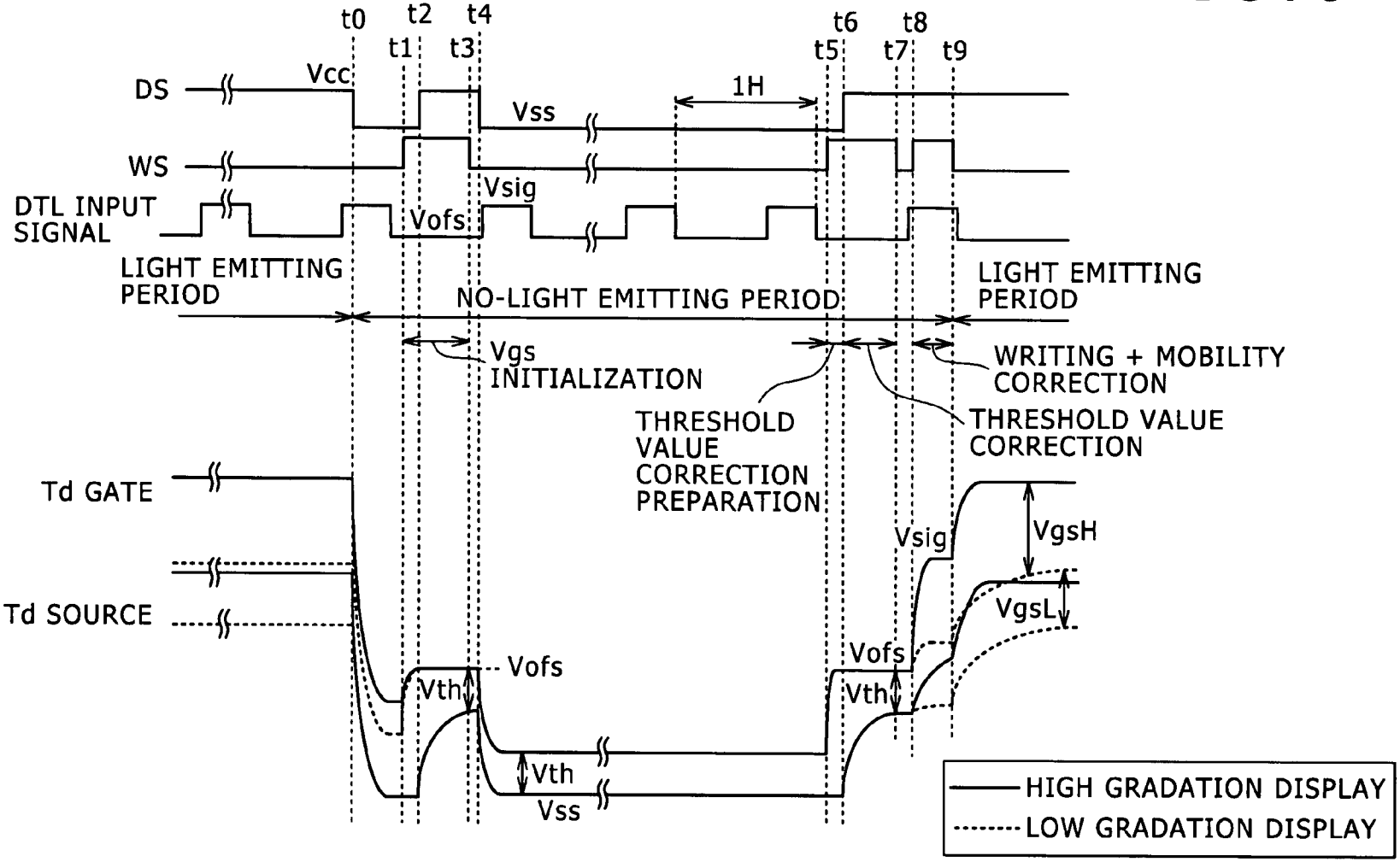
FIG. 6 is a waveform diagram illustrating pixel circuit operation according to an embodiment of the present invention.

FIG. 6 illustrates pixel circuit operation according to the embodiment of the present invention. The pixel circuit operation is described in detail below with additional reference to equivalent circuit diagrams and so forth of FIGS. 7A to 10C.

Figure 7A:
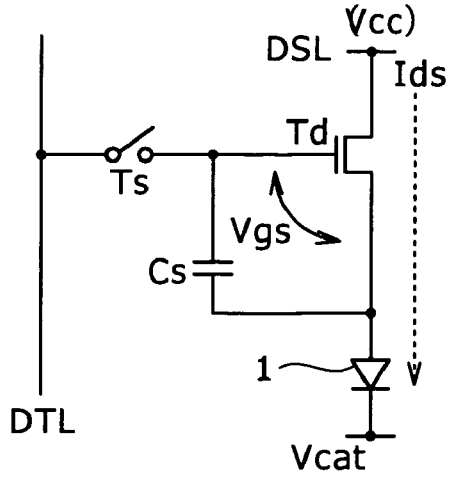
FIGS. 7A to 7C, 8A and 8C, 9A to 9C and 10A and 10C are circuit diagrams of equivalent circuits of the pixel circuits shown in FIG. 2 illustrating operation of the circuits

Till time t0 in FIG. 6, light emission in a preceding frame is carried out. The equivalent circuit in this light emitting state is such as shown in FIG. 7A.

In particular, the driving voltage Vcc is supplied to the power supply controlling line DSL. The sampling transistor Ts is in an off state. At this time, since the driving transistor Td is set so as to operate in the saturation region thereof, the current Ids flowing to the organic EL element 1 assumes a value indicated by the expression (1) given hereinabove in accordance with the gate-source voltage Vgs of the driving transistor Td.

After time t0 of FIG. 6, operation for one cycle for light emission in a present frame is carried out.

This one cycle is a period up to a timing corresponding to time t0 in a next frame.

At time t0, the drive scanner 12 sets the power supply controlling line DSL to the initial voltage Vss.

The initial voltage Vss is set lower than the sum of the threshold voltage Vthel and the cathode potential Vcat of the organic EL element 1. In short, the initial voltage Vss is set so as to satisfy Vss<Vthel+Vcat.

Figure 7B:
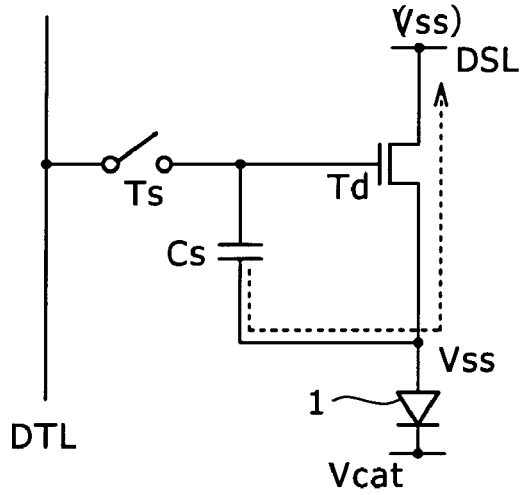

Consequently, the organic EL element 1 stops the emission of light, and current flows toward the power supply controlling line DSL as seen in FIG. 7B and the anode of the organic EL element 1 is charged to the initial voltage Vss. In other words, in FIG. 6, the source voltage of the driving transistor Td drops down to the initial voltage Vss.

Within a period from time t1 to time t3, initialization of the gate-source voltage Vgs of the driving transistor Td is carried out.

Figure 7C:
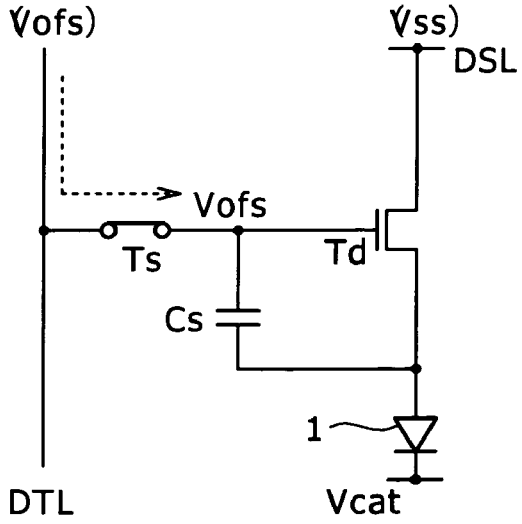

At time t1, the signal line DTL is set to the potential of the reference value Vofs by the horizontal selector 11. Within a period within which the signal line DTL has the potential of the reference value Vofs, the scanning pulse WS is set to the H level to turn on the sampling transistor Ts. Consequently, the reference value Vofs is applied to the gate of the driving transistor Td as seen in FIG. 7C, and the gate voltage becomes equal to the reference value Vofs. The potential of the anode of the organic EL element 1 remains the initial voltage Vss.

At this time, the gate-source voltage of the driving transistor Td is sufficiently higher than the gate-source voltage Vgs.

Then at time t2, the power supply pulse DS of the power supply controlling line DSL is set to the driving voltage Vcc. Consequently, current flows from the power supply controlling line DSL toward the anode of the organic EL element 1 as seen in FIG. 8A.

Figure 8A:
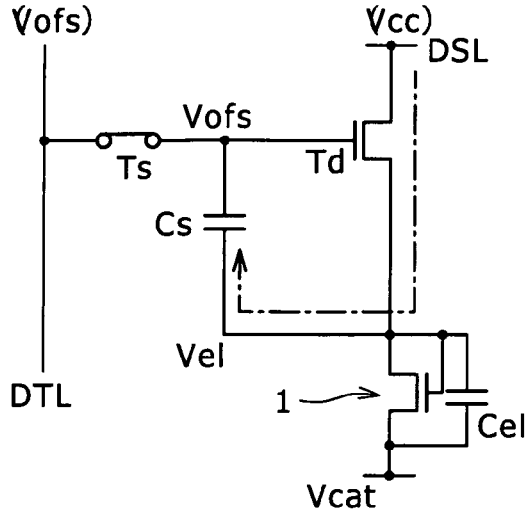

The equivalent circuit of the organic EL element 1 is represented by a diode and a capacitor Cel as shown in FIG. 8A. Therefore, as long as the anode potential Vel of the organic EL element 1 satisfies Vel≦Vcat+Vthel, the current of the driving transistor Td is used to charge the capacitor Cs and the capacitor Cel. The representation as long as the anode potential Vel of the organic EL element 1 satisfies Vel≦Vcat+Vthel signifies that the leak current of the organic EL element 1 is considerably lower than the current flowing to the driving transistor Td.

Figure 8B:
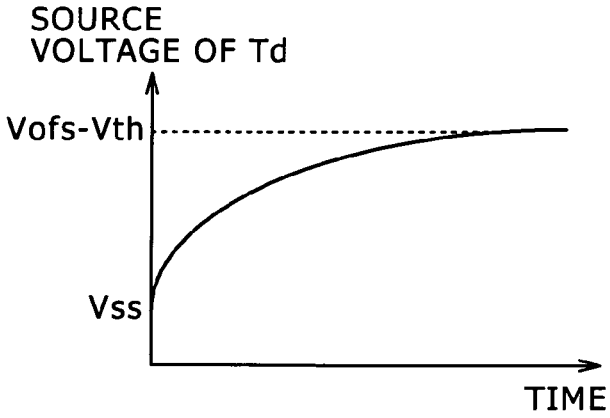
FIGS. 8B and 10B are diagrammatic views illustrating characteristics of the circuits.

At this time, the anode potential Vel, that is, the source potential of the driving transistor Td, rises as seen in FIG. 8B together with time. After lapse of a fixed period of time, the gate-source voltage of the driving transistor Td assumes the value of the threshold voltage Vth.

Figure 8C:
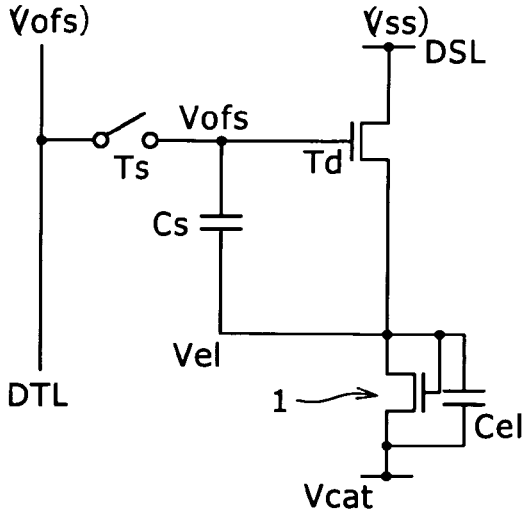

At this time, Vel=Vofs−Vth≦Vcat+Vthel is satisfied. Thereafter, at time t3, the scanning pulse WS changes over to the L level to turn off the sampling transistor Ts thereby to complete the Vgs initialization operation. Further, at time t4, the power supply pulse DS is set to the initial voltage Vss as seen in FIG. 8C.

In particular, as seen in FIG. 6, at this time t3, the gate-source voltage Vgs of the driving transistor Td is initialized to the threshold voltage Vth.

Then at time t4, the power supply controlling line DSL is changed over from the driving voltage Vcc to the initial voltage Vss, and consequently, the gate potential and the source potential of the driving transistor Td drop. In particular, the source potential drops to the initial voltage Vss, and the gate potential drops in response to the immediately preceding gate-source voltage Vgs, which is equal to the threshold voltage Vth.

In short, irrespective of high gradation display/low gradation display, the gate-source voltage Vgs is initialized to the threshold voltage Vth. Then, this state is maintained until threshold value correction preparation is started at time t5.

Figure 9A:
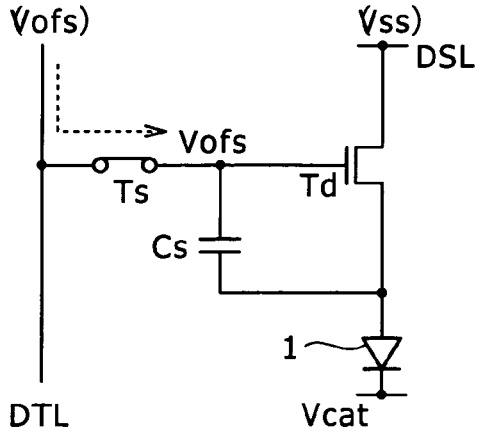

Thereafter, a preparation for threshold value correction operation is carried out within a period from time t5 to time t6. When the signal line DTL is equal to the reference value Vofs, the scanning pulse WS is set to the H level to turn on the sampling transistor Ts as seen in FIG. 9A.

Consequently, as seen in FIG. 6, the gate potential of the driving transistor Td is made equal to the potential of the reference value potential Vofs.

At this time, since the power supply controlling line DSL remains the initial voltage Vss, the gate-source voltage of the driving transistor Td has the value of Vofs−Vss.

Thus, to set the gate potential and the source potential of the driving transistor Td sufficiently higher than the threshold voltage Vth of the driving transistor Td makes preparations for a threshold value correction operation. Accordingly, it is necessary for the reference value potential Vofs and the initial voltage Vss to be set so as to satisfy Vofs−Vss>Vth.

The threshold value correction operation is carried out within a period from time t6 to time t7.

Figure 9B:
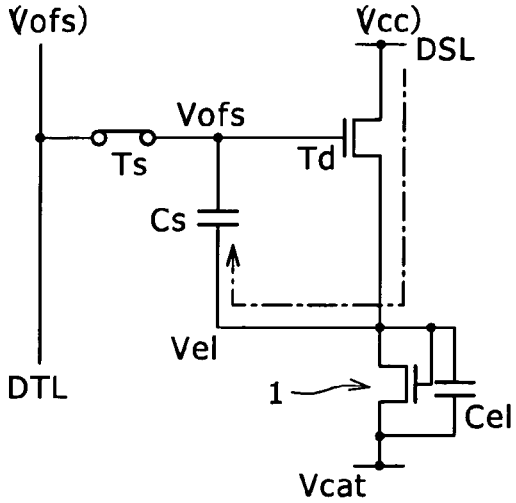

In this instance, the power supply pulse DS of the power supply controlling line DSL is set to the driving voltage Vcc. Consequently, current flows as seen in FIG. 9B.

Also in this instance, the current of the driving transistor Td is used to charge up the holding capacitor Cs and the capacitor Cel as long as the leak current of the organic EL element 1 is considerably smaller than the current flowing to the driving transistor Td.

At this time, the anode potential Vel, that is, the source potential of the driving transistor Td, rises as time passes as seen in FIG. 8B. After lapse of a fixed period of time, the gate-source voltage of the driving transistor Td assumes the value of the threshold voltage Vth. At this time, Vel=Vofs−Vth≦Vcat+Vthel is satisfied.

Figure 9C:
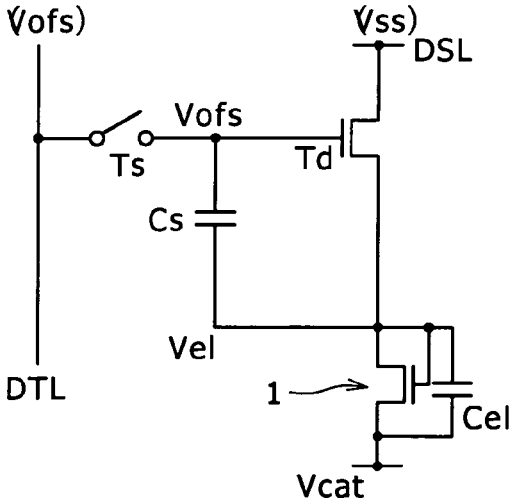

Thereafter, at time t7, the scanning pulse WS is set to the L level and the sampling transistor Ts is turned off to complete the threshold value correction operation as seen in FIG. 9C.

Figure 10A:
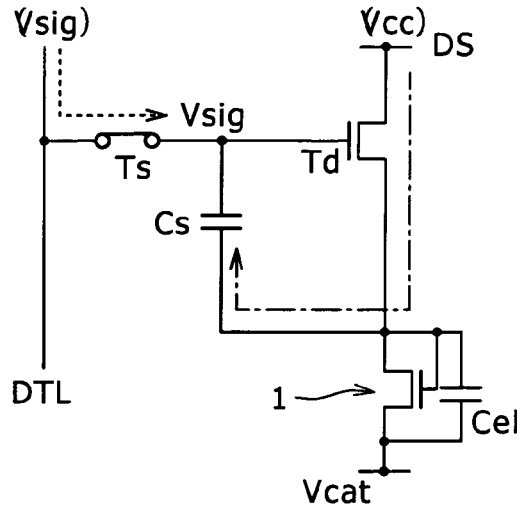

Then, the signal line potential becomes the potential Vsig, and then at time t8, the scanning pulse WS is set to the H level and the sampling transistor Ts is turned on so that the signal value potential Vsig is inputted to the gate of the driving transistor Td as seen in FIG. 10A.

The signal value potential Vsig indicates a voltage corresponding to a gradation. Since the sampling transistor Ts is on, the gate potential of the driving transistor Td becomes the potential of the signal value potential Vsig. However, since the power supply controlling line DSL indicates the driving voltage Vcc, current flows, and the source potential of the sampling transistor Ts rises as time passes.

At this time, if the source voltage of the driving transistor Td does not exceed the sum of the threshold voltage Vthel and the cathode potential Vcat of the organic EL element 1, then the current of the driving transistor Td is used to charge up the holding capacitor Cs and the capacitor Cel. In other words, if the leak current of the organic EL element 1 is considerably lower than the current flowing to the driving transistor Td, then the current of the organic EL element 1 is used for the charging.

Then at this time, since the threshold value correction operation of the driving transistor Td has been completed, the current supplied from the driving transistor Td represents the mobility μ.

Figure 10B:
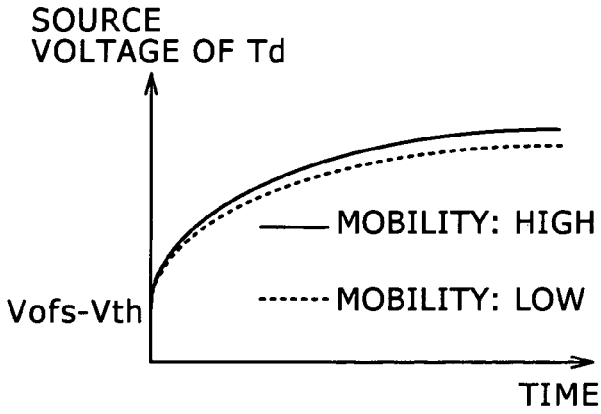

In particular, where the mobility is high, the amount of current at this time is great, and also the speed of the rise of the source potential is high. On the contrary, where the mobility is low, the amount of current at this time is small, and also the speed of the rise of the source potential is low. FIG. 10B indicates rises of the source voltage where the mobility is high and low.

Consequently, the gate-source voltage of the driving transistor Td decreases reflecting the mobility, and after lapse of a fixed period of time, it becomes equal to the gate-source voltage Vgs with which the mobility is corrected fully.

In this manner, within the period from time t8 to time t9, writing of the signal value potential Vsig into the holding capacitor Cs and mobility correction are carried out.

Then at time t9, the scanning pulse WS falls and the sampling transistor Ts is turned off to end the signal value writing, and the organic EL element 1 emits light.

Figure 10C:
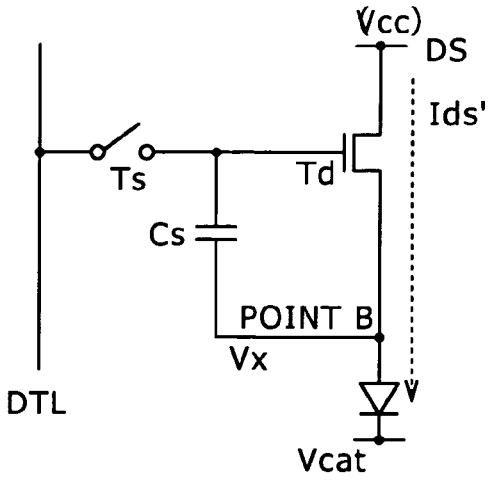

Since the gate-source voltage Vgs of the driving transistor Td is fixed, the driving transistor Td supplies fixed current Ids' to the organic EL element 1 as seen in FIG. 10C. The anode potential Vel at a point B, that is, the anode potential of the organic EL element 1, rises to a voltage Vx with which the fixed current Ids' flows to the organic EL element 1, and the organic EL element 1 emits light.

Thereafter, the emission of light is continued till a next light emission cycle, that is, till time t0 of the next frame.

It is to be noted that, in such operation as described above, if a long period of light emitting time of the organic EL element 1 passes, then the I-V characteristic of the organic EL element 1 varies. Therefore, also the potential at the point B in FIG. 8C varies.

However, since the gate-source voltage Vgs of the driving transistor Td is kept at a fixed value, the current to flow to the organic EL element 1 does not vary. Therefore, even if the I-V characteristic of the organic EL element 1 degrades, the fixed current always continues to flow and the luminance of the EL element does not vary.

Further, with the pixel circuit operation of the embodiment described above, the gate-source voltage Vgs within a no-light emitting period is kept fixed irrespective of the display gradation. Therefore, it is possible to reduce the difference in degree of variation of the threshold voltage of the driving transistor Td for each pixel thereby to implement reduction of a screen burn by a difference in current gradation. In addition, the drawbacks involved in the operations described hereinabove with reference to FIGS. 3, 4 and 5 are eliminated.

First, within a period from time t1 to time t3, the gate-source voltage of the driving transistor Td is initialized so as to be equal to the threshold voltage Vth of the driving transistor Td. Then till time t5 at which a threshold value correction preparation is started, that is, within most part of a no-light emitting period, the gate-source voltage Vgs is maintained equal to the threshold voltage Vth.

In other words, irrespective of whether high gradation display is carried out or low gradation display is carried, the gate-source voltage of the driving transistor can be kept fixed before operation regarding threshold value correction is carried out within the no-light emitting period.

Therefore, the difference in threshold value variation of the driving transistor Td by high gradation display/low gradation display can be minimized. In other words, the difference in time-dependent variation of current flowing to the light emitting element can be minimized. As a result, reduction of a screen burn by a difference in current degradation can be implemented.

Further, the initialization of the gate-source voltage Vgs is carried out substantially similarly to that in the threshold value correction operation. By carrying out such an initialization operation as just mentioned after the light emission of the organic EL element 1 stops, the gate-source voltage Vgs of the driving transistor Td can be made lower than the gate-source voltage Vgs in the operation described hereinabove with reference to FIG. 14 as the related art circuit operation.

For example, upon low gradation display in FIG. 14, the gate-source voltage Vgs remains equal to the voltage VgsL for a period before threshold value correction preparation is started. In contrast, in the case of the present operation, the gate-source voltage Vgs is equal to the threshold voltage Vth which is lower than the voltage VgsL.

As described hereinabove, generally a TFT suffers from variation of the threshold voltage Vth in response to the gate-source voltage Vgs thereof. Then, as the gate-source voltage Vgs increases, the degree of variation of the threshold voltage Vth increases.

Consequently, in the case of the present example, the degree of variation of the threshold voltage Vth can be reduced from that upon low gradation display in FIG. 14. In this regard, the operation of the present example does not exhibit the drawbacks described hereinabove in connection with FIG. 3, and is considered very advantageous against time-dependent deterioration.

Further, in the case of the present example, since the power supply controlling line DSL is set to the initial voltage Vss at time t4 after the gate-source voltage Vgs is initialized, the reverse bias voltage to be applied to the organic EL element 1 can be made equal to the voltage in the case of the operation described hereinabove with reference to FIG. 14, that is, to the initial voltage Vss.

In other words, such a disadvantage that degradation of the efficiency of the organic EL element 1 increases as described hereinabove in connection with FIG. 4 does not occur in comparison with the related art operation.

As described above, with the pixel circuit operation of the present embodiment, reduction of a screen burn by a difference in current degradation by high gradation display/low gradation display is implemented. Further, the gate-source voltage of the driving transistor Td within a no-light emitting period can be reduced to reduce the progress of degradation. Furthermore, also the reverse bias voltage to be applied to the organic EL element 1 may be equal to that in the related art operation without changing the current amplitude.

4. Pixel Circuit Operation According to Another Embodiment

Figure 11:
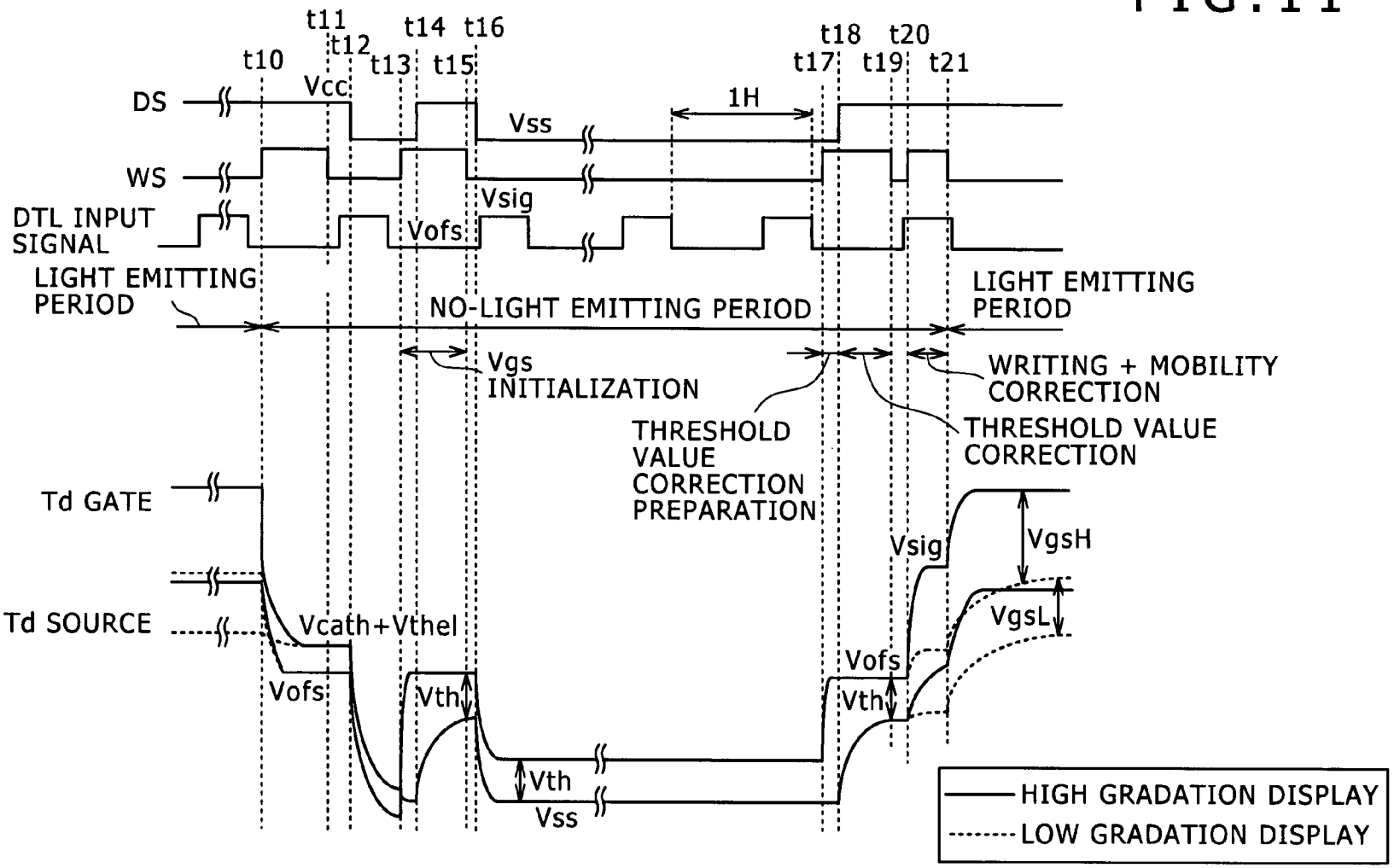
FIG. 11 is a waveform diagram illustrating pixel circuit operation according to another embodiment of the present invention.
Figure 12A:
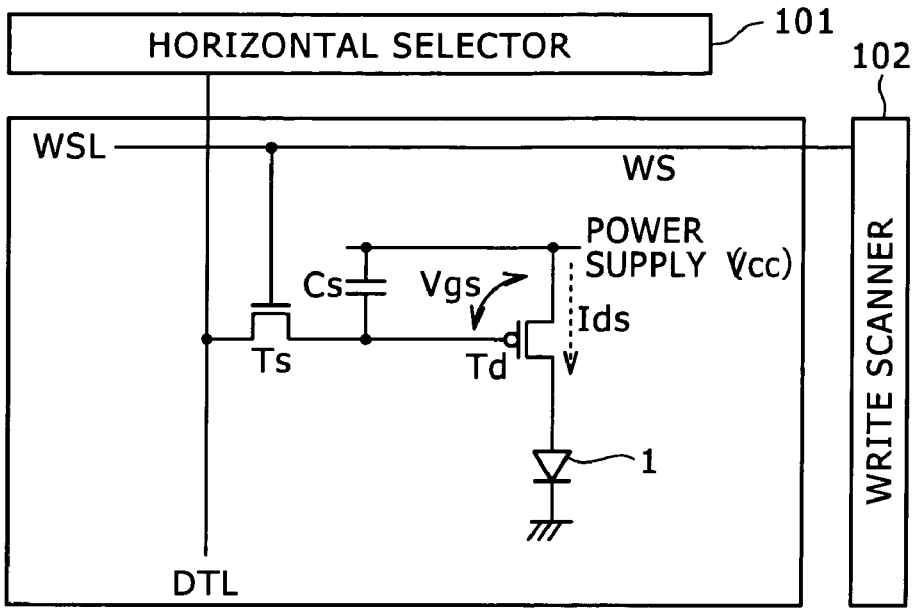
FIG. 12A is a block circuit diagram showing a related art pixel circuit and FIG. 12B is a diagram illustrating a time-dependent variation of an I-V characteristic of an EL element of the pixel circuit of FIG. 12A.
Figure 12B:
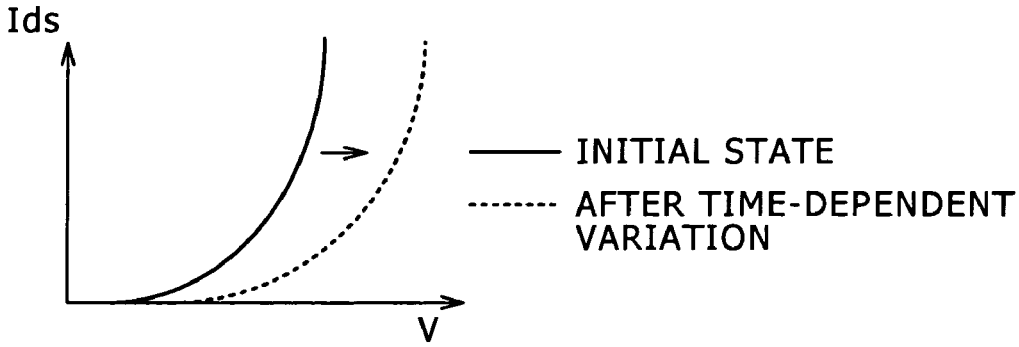
Figure 13A:
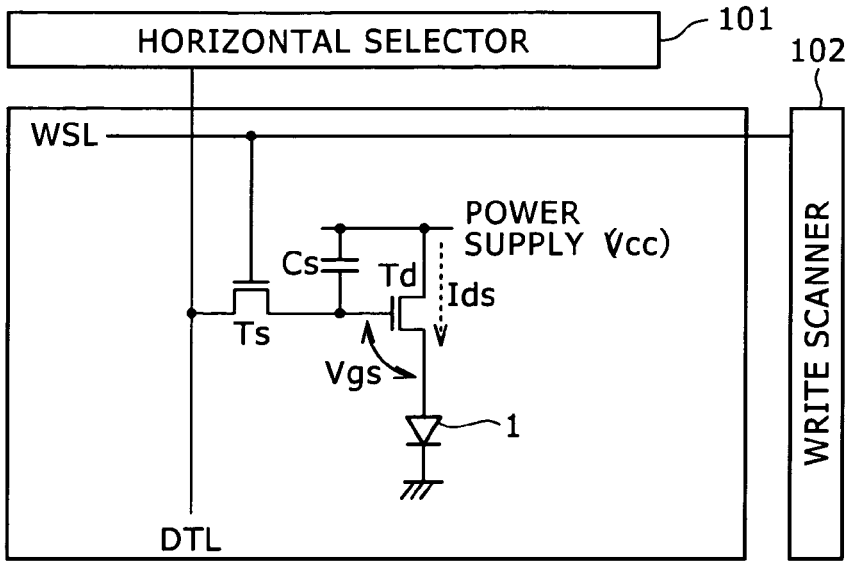
FIGS. 13A and 13B are block circuit diagrams showing related art pixel circuits.
Figure 13B:
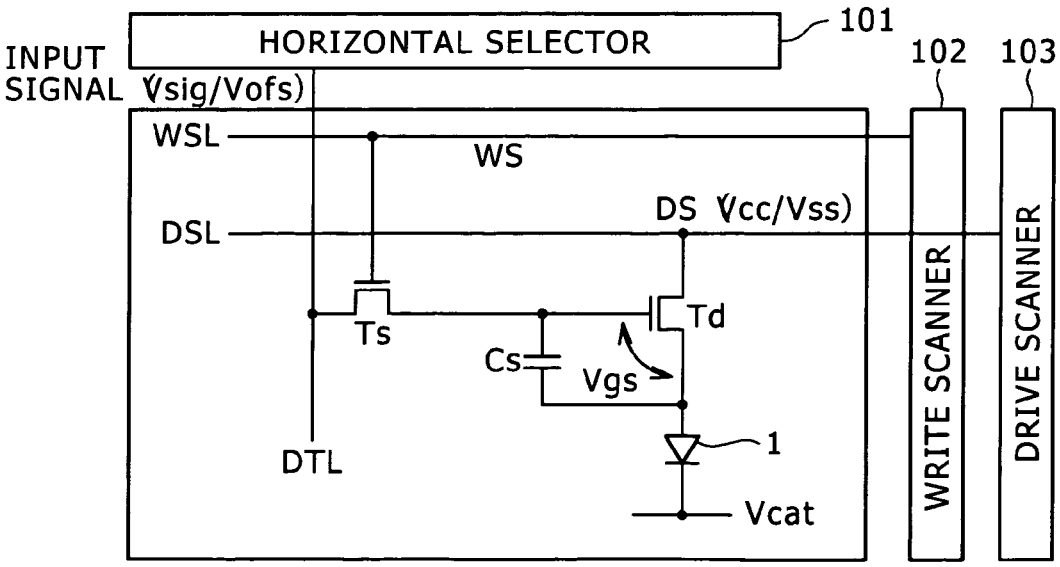

FIG. 11 shows an example of pixel circuit operation of another embodiment of the present invention.

In the pixel circuit operation, stopping of emission of light of the organic EL element 1 is carried out not with the power supply pulse DS of the power supply controlling line DSL but with the scanning pulse WS.

Referring to FIG. 11, emission of light in a preceding frame is carried out till time t10, and within a period from time t10 to time t11, the scanning pulse WS is set to the H level to carry out stopping of the light emission. In other words, when the signal line DTL is set to the reference value Vofs, the sampling transistor Ts is turned on to set the gate voltage of the driving transistor Td to the reference value Vofs.

In short, the gate-source voltage Vgs of the driving transistor Td is set lower than the threshold voltage Vth of the driving transistor Td to stop current from flowing to the organic EL element 1 thereby to stop the emission of light. The source voltage is equal to the threshold voltage Vthel of the organic EL element 1+cathode voltage Vcat.

Thereafter, at time t12, the power supply pulse DS is set to the initial voltage Vss. Consequently, the gate voltage and the source voltage vary in such a manner as illustrated in FIG. 8B.

Within a period from time t13 to time t15, initialization of the gate-source voltage Vgs of the driving transistor Td is carried out.

In particular, at time t13, the signal line DTL is set to a potential of the reference value Vofs by the horizontal selector 11. Within a period within which the signal line DTL has the potential of the reference value Vofs, the scanning pulse WS is set to the H level to turn on the sampling transistor Ts. Consequently, the reference value Vofs is applied to the gate of the driving transistor Td and the gate potential becomes equal to the reference value Vofs. The anode of the organic EL element 1 has the initial voltage Vss similarly as in FIG. 7C.

At this time, the gate-source voltage of the driving transistor Td is sufficiently higher than the gate-source voltage Vgs.

Then at time t14, the power supply pulse DS of the power supply controlling line DSL is set to the driving voltage Vcc. Consequently, current flows from the power supply controlling line DSL toward the anode of the organic EL element 1 as seen in FIG. 8A.

In this instance, as long as the anode potential Vel of the organic EL element 1 satisfies Vel≦Vcat+Vthel, the current of the driving transistor Td is used to charge the capacitor Cs and the capacitor Cel. After all, the anode potential Vel, that is, the source potential of the driving transistor Td, rises together with time, and after lapse of a fixed period of time, the gate-source voltage of the driving transistor Td assumes a value equal to threshold voltage Vth.

Thereafter, at time t15, the scanning pulse WS is changed over to the L level to turn off the sampling transistor Ts to thereby complete the Vgs initialization operation. Further at time t16, the power supply pulse DS is set to the initial voltage Vss similarly as in FIG. 8C.

In particular, as seen in FIG. 11, the gate-source voltage Vgs of the driving transistor Td is initialized to the threshold voltage Vth at time t15. Then, at time t16, the power supply controlling line DSL is changed over from the driving voltage Vcc to the initial voltage Vss. Consequently, the gate voltage and the source voltage of the driving transistor Td drop. In particular, the source potential drops to the initial voltage Vss and the gate potential drops while the immediately preceding gate-source voltage Vgs is kept equal to the threshold voltage Vth.

In short, the gate-source voltage Vgs is initialized to the threshold voltage Vth irrespective of high gradation display/low gradation display. Then, this state is maintained until threshold value correction preparation is started at time t17.

After time t17, operation similar to that after time t5 described hereinabove with reference to FIG. 6 is carried out.

Even with such operation example as described above, the period of time within which the gate-source voltage of the driving transistor Td is equal within a no-light emitting period can be made longer irrespective of high gradation display/low gradation display. Therefore, the difference in time-dependent variation of current by high gradation display/low gradation display can be further reduced, and effects similar to those achieved by the embodiment described hereinabove with reference to FIG. 6 can be anticipated.

Particularly, the example of FIG. 11 is appropriate where a method wherein the light emission stopping timing is determined with the scanning pulse WS is adopted.

While the embodiments of the present invention have been described, the present invention can be carried out in various modified forms.

For example, while the threshold value correction is carried out within the period from time t6 to time t7 in the example of FIG. 6 or from time t18 to time t19 in the example of FIG. 11, also it is possible to divide the threshold value correction period into a plurality of period portions to carry out the threshold value correction.

Further, while it is described that the pixel circuit has a circuit configuration described hereinabove with reference to FIG. 2, the pixel circuit may have a different circuit configuration.

In particular, the driving method according to the present invention can be applied suitably to a pixel circuit which includes at least a light emitting element such as an organic EL element 1, a driving transistor Td for applying current in response to a signal value applied between the gate and the source thereof to the light emitting element and a capacitor Cs connected between the gate and the source of the driving transistor Td.

The present application contains subject matter related to that disclosed in Japanese Priority Patent Application JP 2009-115196 filed in the Japan Patent Office on May 12, 2009, the entire content of which is hereby incorporated by reference.

While a preferred embodiment of the present invention has been described using specific terms, such description is for illustrative purposes only, and it is to be understood that changes and variations may be made without departing from the spirit or scope of the following claims.

What is claimed is:

1. A display apparatus, comprising:

a pixel array including a plurality of pixel circuits disposed in a matrix and each including a light emitting element, a driving transistor for supplying current in response to a signal value applied between a gate and a source thereof to said light emitting element when a driving voltage is applied between a drain and the source thereof, and a holding capacitor connected between the gate and the source of said driving transistor for holding the input signal value; and a light emission driving section configured to apply the signal value to said holding capacitor of each of said pixel circuits of said pixel array so that the light emitting element of the pixel circuit emits light with a luminance corresponding to the signal value;

said light emission driving section driving said pixel circuit to carry out, as light emitting operation of one cycle which includes a no-light emitting period and a light emitting period;

ending a light emitting operation of the light emitting element;

fixing the gate of the driving transistor to a predetermined potential and applying a driving voltage between the drain and the source of the driving transistor to initialize the gate-source voltage of the driving transistor;

canceling the fixation of the gate potential of the driving transistor and ending the application of the driving voltage between the drain and the source of the driving transistor to maintain the initialization state of the gate-source voltage;

fixing the gate of the driving transistor to a reference voltage and applying the driving voltage between the drain and the source of the driving transistor to carry out threshold value correction so that the gate-source voltage of the driving transistor may become equal to a threshold voltage of the driving transistor;

applying a voltage as a signal value to the holding capacitor and executing a mobility correction operation of the driving transistor; and supplying current corresponding to the gate-source voltage of the driving transistor on which the signal value is reflected to the light emitting element so that emission of light of the light emitting element with a luminance corresponding to the signal value is executed.

2. A driving method for a pixel circuit which includes a light emitting element, a driving transistor for applying current in response to a signal value applied between a gate and a source thereof to the light emitting element when a driving voltage is applied between a drain and the source thereof, and a holding capacitor connected between the gate and the source of the driving transistor for holding the input signal value, the driving method comprising steps carried out within a light emitting period of one cycle which includes a no-light emitting period and the light emitting period, the steps including:

a first step of ending a light emitting operation of the light emitting element;

a second step of fixing the gate of the driving transistor to a predetermined potential and applying a driving voltage between the drain and the source of the driving transistor to initialize the gate-source voltage of the driving transistor;

a third step of canceling the fixation of the gate potential of the driving transistor and ending the application of the driving voltage between the drain and the source of the driving transistor to maintain the initialization state of the gate-source voltage;

a fourth step of fixing the gate of the driving transistor to a reference voltage and applying the driving voltage between the drain and the source of the driving transistor to carry out threshold value correction so that the gate-source voltage of the driving transistor may become equal to a threshold voltage of the driving transistor;

a fifth step of applying a voltage as a signal value to the holding capacitor and executing a mobility correction operation of the driving transistor; and a sixth step of supplying current corresponding to the gate-source voltage of the driving transistor on which the signal value is reflected to the light emitting element so that emission of light of the light emitting element with a luminance corresponding to the signal value is executed.

3. The driving method for the pixel circuit according to claim 2, wherein, at the second step, while the gate of the driving transistor is fixed to the predetermined potential, the driving voltage is applied between the drain and the source of the driving transistor to initialize the gate-source voltage of the driving transistor so as to be equal to the threshold voltage of the driving transistor.

4. The driving method for the pixel circuit according to claim 3, wherein the predetermined potential to which the gate of the driving transistor is fixed at the second step is equal to the reference potential to which the gate of the driving transistor is fixed at the fourth step.

5. The driving method for the pixel circuit according to claim 2, wherein, at the first step, the driving voltage application between the drain and the source of the driving transistor is ended to end the light emitting operation of the light emitting element.

6. The driving method for the pixel circuit according to claim 2, wherein, at the first step, the gate-source voltage of the driving transistor is set lower than the threshold voltage to end the light emitting operation of the light emitting element, and then the driving voltage application between the drain and the source of the driving transistor is ended.

* * * * *